US010328952B2

(12) United States Patent
Labasque et al.

(10) Patent No.: US 10,328,952 B2
(45) Date of Patent: Jun. 25, 2019

(54) METHOD FOR MANUFACTURING A DRIVING CABIN OF A RAILWAY VEHICLE, MORE PARTICULARLY FOR A TRAMWAY

(71) Applicant: ALSTOM TRANSPORT TECHNOLOGIES, Saint-Ouen (FR)

(72) Inventors: Damien Labasque, La Rochelle (FR); Bernard Metayer, Croix-Chapeau (FR); Yohan Leber, Valenciennes (FR); Patrick Latry, La Rochelle (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 380 days.

(21) Appl. No.: 15/057,282

(22) Filed: Mar. 1, 2016

(65) Prior Publication Data

US 2017/0021840 A1 Jan. 26, 2017

(30) Foreign Application Priority Data

Mar. 3, 2015 (FR) ..... 15 51782

(51) Int. Cl.

| | |
|---|---|
| ***B61C 17/04*** | (2006.01) |
| ***B61D 13/00*** | (2006.01) |
| ***B61D 17/06*** | (2006.01) |
| ***B61D 25/00*** | (2006.01) |

(52) U.S. Cl.

CPC ..... *B61C 17/04* (2013.01); *B61D 13/00* (2013.01); *B61D 17/06* (2013.01); *B61D 25/00* (2013.01)

(58) Field of Classification Search

CPC ..... B61C 17/04; B61D 13/00; B61D 17/06; B61D 25/00

See application file for complete search history.

(56) References Cited

U.S. PATENT DOCUMENTS 5,673,627 A * 10/1997 Bieber ..... B60J 1/007 105/329.1

FOREIGN PATENT DOCUMENTS

| | | | | |
|---|---|---|---|---|
| DE | 19609995 A1 * | 9/1997 | ..... | B61C 17/04 |
| DE | 19649526 A1 * | 6/1998 | ..... | B61C 17/04 |
| EP | 0 533 582 A1 | 3/1993 | | |
| EP | 0795450 A2 * | 9/1997 | ..... | B61C 17/04 |
| EP | 1008504 A1 * | 6/2000 | ..... | B61D 17/045 |
| EP | 1 958 848 A1 | 8/2008 | | |
| EP | 2 000 382 A1 | 12/2008 | | |
| FR | 3012785 A1 * | 5/2015 | ..... | B61D 17/045 |
| WO | WO-2015140464 A1 * | 9/2015 | ..... | B61D 17/045 |

OTHER PUBLICATIONS

Preliminary Search Report dated Jan. 13, 2016 in related French Application No. FR 15 51782.

* cited by examiner

*Primary Examiner* — Zachary L Kuhfuss
(74) *Attorney, Agent, or Firm* — Eric L. Lane; Green Patent Law

(57) ABSTRACT

The manufacturing method includes a step for manufacturing a structural frame, defining an area intended to house driving equipment, said structural frame including two side walls on either side each having at least one side opening, a step for assembling two side windows, each covering a respective one of the side openings, and, prior to said assembly step, a step for producing two side window supports, each assembled with a respective one of the side walls, each side window being attached on a respective one of the side supports during the assembly step.

4 Claims, 2 Drawing Sheets

METHOD FOR MANUFACTURING A DRIVING CABIN OF A RAILWAY VEHICLE, MORE PARTICULARLY FOR A TRAMWAY

CROSS-REFERENCE TO RELATED APPLICATION

This application claims priority to and benefit of French Patent Application No. FR 15 51782, filed Mar. 3, 2015, which is hereby incorporated by reference in its entirety.

TECHNICAL FIELD

The present invention relates to a method for manufacturing a driving cabin of a railway vehicle, more particularly for a tramway, and such a driving cabin.

BACKGROUND

A driving cabin for a tramway is already known in the state of the art including a structural base frame, defining a housing area for a driver and driving equipment. This structural frame bears windows, in particular side windows.

The driving cabin also includes a fairing, covering the structural frame, and in particular defining the gauge of the driving cabin.

More particularly, driving cabins exist with different dimensions, and in particular different widths.

In this case, the structural frame is manufactured with dimensions adapted to those desired for the driving cabin. It is therefore necessary to provide different manufacturing means based on the desired dimensions for the driving cabin. For example, when the structural frame is made by molding, it is necessary to provide a plurality of molds making it possible to produce different structural frames, in particular having different widths.

This results in a relatively high manufacturing cost, related to the number of molds. Furthermore, the differences in sizes of the structural frames imply different management of the installation of driving equipment based on the available housing space.

SUMMARY OF THE INVENTION

The invention in particular aims to resolve these drawbacks by proposing a method for manufacturing a driving cabin in particular having a reduced cost.

To that end, the invention in particular relates to a method for a driving cabin of a railway vehicle, in particular a tramway, including:

- a step for manufacturing a structural frame, defining an area designed to house driving equipment, said structural frame including two side walls on either side each having at least one side opening,
- a step for assembling two side windows, each covering a respective one of the side openings, characterized in that it includes, prior to said assembly step, a step for producing two side window supports, each assembled with a respective one of the side walls, each side window being attached on a respective one of the side supports during the assembly step.

The method according to the invention provides for the manufacture of a structural base frame having standard dimensions, this standard structural frame being used irrespective of the desired width for the driving cabin.

By adding side supports on this standard structural frame, it is possible to vary the width of the cabin by modifying only the dimensions of these side supports.

If the structural frame is made by molding, the method according to the invention only requires a single primary mold to manufacture the structural frame, which decreases the cost of the manufacturing tools.

Furthermore, the housing area being standard, the driving cabin is easier to manufacture, in particular in that the driving equipment can be assembled in a standard manner in the structural base frame, irrespective of the desired width of the driving cabin.

A method according to the invention may further include one or more of the following features, considered alone and according to any technically possible combinations:

- The method includes a step for trimming the driving cabin, during which the structural frame provided with the side supports is covered by a fairing, having a predetermined maximum dimension in a transverse direction in which the side walls are spaced apart from one another, the dimensions of the side supports in said transverse direction being chosen as a function of said maximum dimension of the fairing.
- The step for manufacturing the structural frame is done by molding using a primary mold.
- The step for producing the side supports is done by co-molding with the structural frame, adding side mold extensions on the primary mold.
- The method includes a step for choosing mold extensions from among a plurality of mold extensions with different dimensions, based on the desired dimensions for the side supports.
- The side supports are made separately from the structural frame, then attached on the side walls of the structural frame.
- The assembly step includes gluing each window on a respective one of the side window supports.

The invention also relates to a driving cabin for a railway vehicle, in particular a tramway, including:

- a structural frame defining a housing area for the driving equipment, said structural frame including, on either side, two side walls each having at least one side opening, and
- two side windows, each intended to cover a respective one of the side openings, characterized in that it includes two side window supports, each supporting a respective one of the side windows, and each being assembled with a respective one of the side walls of the structural frame.

Advantageously, the driving cabin includes a fairing covering the structural frame, having a predetermined maximum dimension in a transverse direction in which the side walls are spaced apart from one another, the dimensions of the side supports in said transverse direction depending on said maximum dimension of the fairing.

The invention lastly relates to an assembly of at least two driving cabins as previously defined, characterized in that:

- the structural frames of all of the driving cabins are identical, and
- the side supports of the least one of the driving cabins having dimensions different from the side supports of at least one other of the driving cabins.

BRIEF DESCRIPTION OF THE DRAWINGS

The invention will be better understood upon reading the following description, provided solely as an example and done in reference to the appended figures, in which.

DETAILED DESCRIPTION OF PREFERRED EMBODIMENTS

Figure 4:
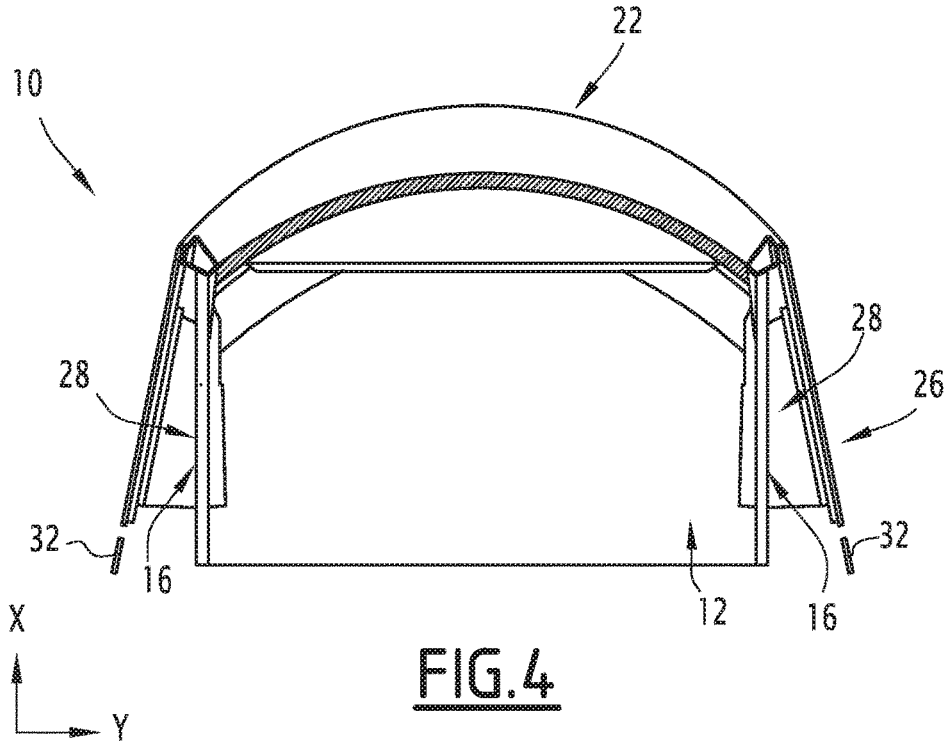
FIGS. 4 and 5 are partial sectional views, in a horizontal cutting plane, of a driving cabin for a railway vehicle including the structural frame of FIG. 1, and respectively including the side supports of FIGS. 2 and 3.
Figure 5:
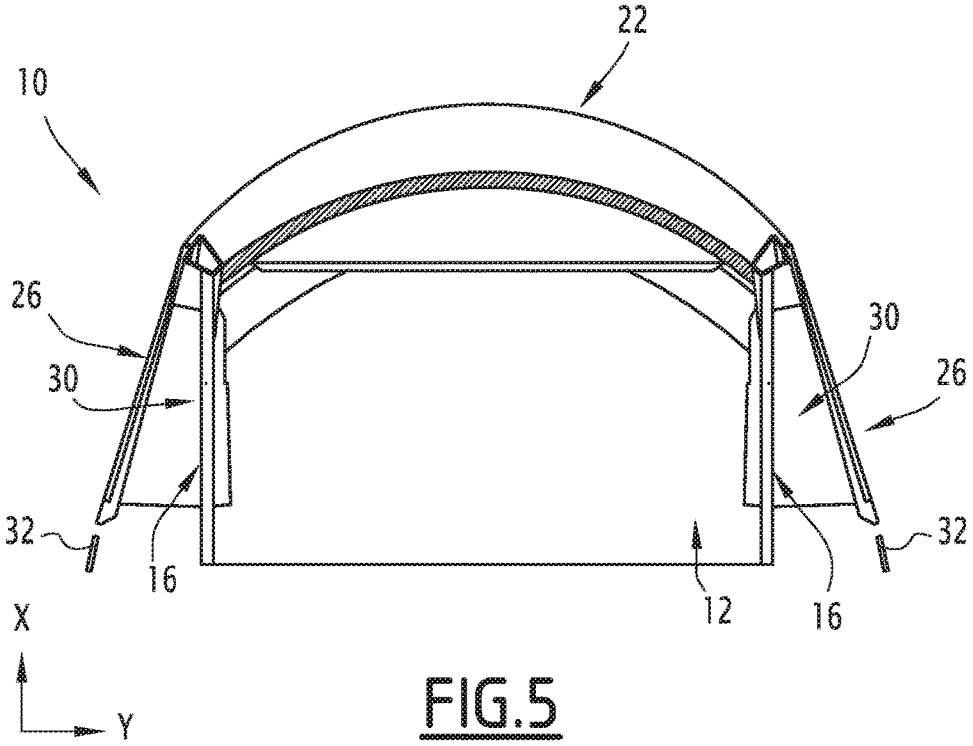

The figures, and in particular FIGS. 4 and 5, show a driving cabin 10 for a railway vehicle, in particular an urban railway vehicle such as a tramway.

Figure 1:
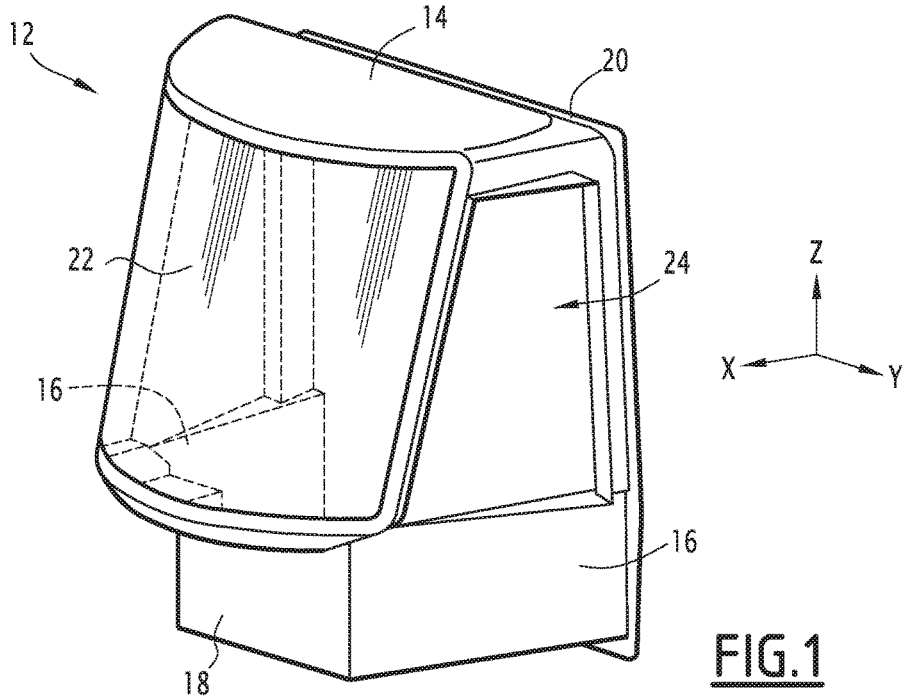
FIG. 1 is a perspective view of a structural base frame of a driving cabin according to one example embodiment of the invention.

The driving cabin 10 includes a structural base frame 12, shown in more detail in FIG. 1, designed to define a housing area for driving equipment. This driving equipment is traditional, and in particular includes a driving console and a driver's seat.

The structural frame 12 in particular includes an upper wall 14, side walls 16 spaced apart from one another in a transverse direction Y, and a front wall 18.

The structural frame 12 also includes, opposite the front wall 18 in a longitudinal direction X perpendicular to the transverse direction Y, a fastening frame 20 for fastening the driving cabin 10 to a passenger cabin structure of the railway vehicle.

The front wall 18 traditionally includes a front opening, covered by a front window 22.

Figure 2:
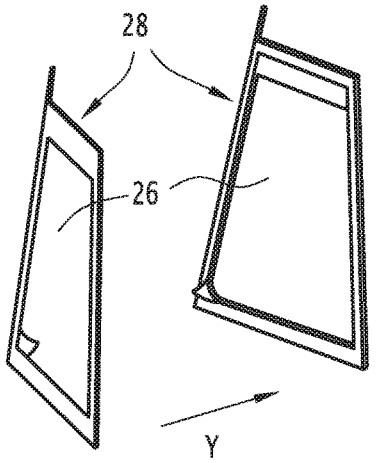
FIGS. 2 and 3 are perspective views of side window supports, respectively having different transverse dimensions.
Figure 3:
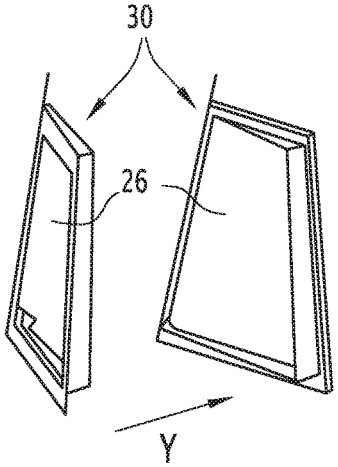

Likewise, the side walls 16 each include at least one side opening 24, designed to be covered by a respective side window 26, shown in FIGS. 2 and 3.

The structural frame 12 is standard, i.e., it can serve as a base for the manufacture of different driving cabins having different dimensions, and more particularly different widths. It will be noted that in the present description, the term "width" has its usual meaning for a driving cabin, and therefore corresponds to the dimension in the transverse direction Y.

In order to produce driving cabins with different widths, the structural frame 12 is assembled with two side window supports 28 or 30, each side support 28 or 30 bearing a respective one of the side windows 26. Each of these side supports 28 or 30 is designed to be assembled with a respective one of the side walls 16 of the structural frame 12.

More particularly, FIG. 2 shows first side supports 28, having a first transverse dimension, considered in the transverse direction Y, and in FIG. 3, second side supports 30, having a second transverse dimension in the transverse direction Y, different from the first transverse dimension. For example, the second transverse dimension is larger than the first transverse dimension.

The driving cabin 10 shown in FIG. 4, called "first driving cabin", is equipped with first side supports 28, and the second driving cabin 10 of FIG. 5, called "second driving cabin", is equipped with second side supports 30. It then clearly appears that the second driving cabin has a transverse dimension, considered in the transverse direction Y, larger than the transverse dimension of the first driving cabin.

For example, the transverse dimension of the first driving cabin 10 is 2400 mm, and the transverse dimension of the second driving cabin 10 is 2650 mm.

It should be noted that the side windows 26 have substantially identical dimensions irrespective of the transverse dimension of the corresponding side window support 28 or 30.

Each driving cabin 10 furthermore includes a fairing 32, covering the structural frame 12. The fairing 32 has a predetermined maximum dimension, corresponding to the desired width of the driving cabin 10. The dimensions of the side supports 28 or 30 are therefore chosen as a function of this maximum dimension of the fairing 32.

More particularly, in the described example, for a fairing 32 with a reduced transverse dimension, the first side supports 28 will be chosen, and for a fairing with a larger transverse dimension, the second side supports 30 will be chosen.

Of course, it is possible to provide other side supports with dimensions different from those of the first 28 and second 30 side supports previously described.

It is thus possible to produce a plurality of driving cabin 10, each driving cabin 10 including a standard structural frame 12, and side window supports, the dimensions of which depend on the desired width for this driving cabin. In other words, the structural frames 12 of the driving cabins 10 are identical, and the side supports of at least one of the driving cabins 10 have dimensions, in particular a transverse dimension, different from those of the side supports of at least one other of the driving cabins 10.

A method for manufacturing the driving cabin 10 of FIG. 4 or 5 will now be described.

This manufacturing method includes a step for manufacturing a structural base frame 12, identical irrespective of the desired width of the driving cabin 10.

This manufacturing step is for example done by molding using a primary mold corresponding to the shape of the structural base frame 12. Thus, a single primary mold is used, irrespective of the desired width of the driving cabin 10.

The method further includes a step for producing two side window supports 28 or 30, each being designed to be assembled with a respective one of the side walls 16 of the structural frame 12.

Advantageously, the side supports 28 or 30 are made by co-molding with the structural frame 12, by adding side mold extensions on the primary mold and performing a single "one-shot" molding operation. In this case, this production step is preceded by a step for choosing mold extensions added to the primary mold from among a plurality of different mold extensions, as a function of the desired dimensions for the side supports.

For example, one has first mold extensions corresponding to the first side supports 28, and second mold extensions corresponding to the second side supports 30.

Alternatively, the side supports 28 or 30 are made separately from the structural frame 12, then are attached on the side walls 16 of that frame 12.

The method next includes a step for assembling two side windows 26, such that each of the side windows 26 covers a respective one of the side openings 24. To that end, each side window 26 is attached on a respective one of the side supports 28 or 30, for example by gluing.

The method lastly includes a step for trimming the driving cabin 10, during which the structural frame 12, provided with lateral supports 28 or 30, is covered by the fairing 32. This fairing 32 has a predetermined maximum dimension in the transverse direction Y, corresponding to the desired width of the driving cabin 10. As previously indicated, the side supports 28 or 30 are chosen as a function of the maximum dimension of the fairing 32.

It should be noted that the driving cabin 10 according to the invention is largely standard, and in particular the inner space defined by the structural frame 12 has standard dimensions.

It will be noted that the invention is not limited to the embodiment previously described, but could assume various alternatives.

In particular, according to one alternative that is not shown, the driving cabin 10 may be obtained by assembling two side half-cabins, symmetrical relative to a vertical median plane. Each half-cabin is then made using the same method for manufacturing a cabin previously described.

More particularly, this method uses a primary mold to form a structural half-frame, and a mold extension to form the corresponding side support. The method then includes a co-molding operation to form the half-cabin. The method next includes the assembly of the two half-cabins, for example by traditional mechanical connections.

The method lastly includes the assembly of the windows and the trim, in the same manner as in the method previously described.

The invention claimed is:

1. A method for a driving cabin of a railway vehicle, including:

a step for manufacturing a structural frame, defining an area designed to house driving equipment, said structural frame including two side walls on either side each having at least one side opening, a step for assembling two side windows, each covering a respective one of the side openings, wherein:

the manufacturing method includes, prior to said assembly step, a step for producing two side window supports, each assembled with a respective one of the side walls, each side window being attached on a respective one of the side supports during the assembly step, the step for manufacturing the structural frame is done by molding using a primary mold, the step for producing the side supports is done by co-molding with the structural frame, adding side mold extensions on the primary mold, and wherein the manufacturing method includes a step for choosing mold extensions from among a plurality of mold extensions with different dimensions, based on the desired dimensions for the side supports.

2. The manufacturing method according to claim 1, wherein the assembly step includes gluing each window on a respective one of the side window supports.

3. The manufacturing method according to claim 1, wherein the railway vehicle is a tramway.

4. The manufacturing method according to claim 1, including a step for trimming the driving cabin, during which the structural frame provided with the side supports is covered by a fairing, having a predetermined maximum dimension in a transverse direction in which the side walls are spaced apart from one another, the dimensions of the side supports in said transverse direction being chosen as a function of said maximum dimension of the fairing.

* * * * *